US005510583A

United States Patent [19]

Pescetto

[11] Patent Number: 5,510,583

[45] Date of Patent: Apr. 23, 1996

[54] ASSEMBLY FOR SEQUENTIAL SWITCHING

[75] Inventor: James R. Pescetto, Hanover Park, Ill.

[73] Assignee: Eaton Corporation, Cleveland, Ohio

[21] Appl. No.: 210,868

[22] Filed: Mar. 18, 1994

[51] Int. Cl.[6] ..... H01H 9/26; H01H 21/80

[52] U.S. Cl. ..... 200/1 B; 200/5 C; 50.35 C; 200/6 R

[58] Field of Search ..... 200/1 R, 1 B, 200/4, 5 R, 5 B, 5 C, 5 D, 6 R, 6 B, 6 BA, 6 BB, 6 C, 17 R, 18, 50 R, 50 C, 553, 557, 558, 559, 560, 562, 339

[56] References Cited

U.S. PATENT DOCUMENTS

| | | | |
|---|---|---|---|
| 2,854,533 | 9/1958 | DeLancey | 200/6 |
| 3,596,023 | 7/1971 | Kothe et al. | 200/83 |
| 3,619,520 | 11/1971 | Garnett | 200/5 F |
| 4,927,990 | 5/1990 | Aoki et al. | 200/517 |
| 4,967,043 | 10/1990 | Killarney | 200/1 B |
| 5,089,715 | 2/1992 | Kokubu | 307/10.1 |

*Primary Examiner*—Kristine L. Kincaid
*Assistant Examiner*—Michael A. Friedhofer
*Attorney, Agent, or Firm*—Roger A. Johnston

[57] ABSTRACT

A switch assembly having a rocker type actuator user moveable for actuating plural switches in a housing. The rocker type actuator includes first and second rocker members journalled together for rotation about a common axis. The first member has a paddle extending out of the housing and a first cam portion for actuating a first switch upon initial rotation in one direction. Upon continued rotation in the same direction, overtravel of the first switch is absorbed by a torsion spring which permits resiliently biased lost motion of the first cam with respect to a second cam for subsequent actuation of a second switch. The torsion spring provides a significant increase in the force required to move the actuator between the first and second switch actuation to provide tactiley discernable feedback to the user of the state of switch actuations.

9 Claims, 2 Drawing Sheets

ASSEMBLY FOR SEQUENTIAL SWITCHING

BACKGROUND OF THE INVENTION

The present invention relates to electrical switches and particularly to switches of the type wherein user movement of a paddle or rocker in either of two opposite rotational directions is effective to provide for selective actuation of a plurality of contact sets for effecting opening and closing of the contacts for switching an electrical current in individual circuits. In particular, the invention relates to rocker type switches which upon user movement of the rocker in one direction is effective to sequentially actuate a plurality of switches during successive movement of the rocker.

Rocker-type switches are commonly employed for user actuation of remotely controlled accessories in automobiles as, for example, remote control of electrically operated door locks, powered window motors and outside rearview mirror adjustment motors. In providing such switches for control of vehicle accessories and particularly remote control of vehicle power window motors, it has been desired to provide for an "auto-down" or "express down" mode of operation of the power windows in the driver side vehicle door. This latter type mode of operation of the driver's door window comprises moving the door window motor control switch rocker in one direction for actuating the power window motor to lower the window and continued movement of the switch beyond the initial actuation position to a second position in which an electronic control circuit provides for continuous rotation of the motor to provide for continued lowering of the window after the operator has released pressure from the switch rocker member. However, in providing such "auto-down" or "express down" operation of the driver's side power window motor, it has been desired to provide for a tactilely discernible indication of the secondary actuation of the switch for notifying the driver that the "auto-down" mode has been engaged.

In order to provide a tactilely discernable indication or tactile feedback to the driver that the driver side power window switch has been pushed to the "express down" position, it has been found desirable to provide a significant and noticeable increase in force for causing continued rotation of the switch rocker member after the switch has reached an initial actuation position. However, in providing for such actuation of a secondary switch for the "auto-down" mode of operation without causing detrimental or damaging overtravel of the initially actuated switch has proven to be a difficult problem in manufacturing sequentially operated switches. This has proven to be particularly true where a single rocker or actuator member is employed for actuating plural switches in sequence by movement of the rocker in one direction.

SUMMARY OF THE INVENTION

The present invention provides a rocker actuated type switching assembly in which user movement of the rocker in either of two opposite directions is effective to cause actuation of individual electrical switches mounted within the housing. Upon user rotation of the rocker in one direction by an initial amount, actuation of a first switch is effected; and, upon continued rotation of the rocker actuation of a second separate switch is effected. As the user continues to rotate the switch rocker from actuation of the first switch, the force required to effect the continued rotation is increased; and, the rocker actuation mechanism is operable to undergo lost motion with respect to actuation of the first switch to prevent detrimental or damaging overtravel to the first actuated switch.

The user moveable rocker of the present switch assembly comprises a first rocker member having a first cam for contacting the first switch to be actuated; and, the first rocker member is interconnected by journalling with a second rocker member which is rotatable about a common axis with the first member and capable of lost motion rotation therebetween. The second rocker member has a separate cam for actuating a second switch to be sequentially actuated. The interconnection of the first rocker member and the second rocker member includes a torsion spring which accommodates lost motion movement between the first and second members and provides an increasing bias force during such lost motion movement. The torsion spring provides for the lost motion for limiting overtravel of the first cam after actuation of the first switch to be actuated and also provides for tactilely discernable increase in force or tactile feedback of actuation of the first switch.

BRIEF DESCRIPTION OF THE DRAWINGS

FIG. 6 is an exploded view of the rocker actuator of the switch of FIG. 1 and, FIG. 7 is an exonometric view of the user moveable member of the rocker actuator of FIG. 6.

DETAILED DESCRIPTION

Figure 1:
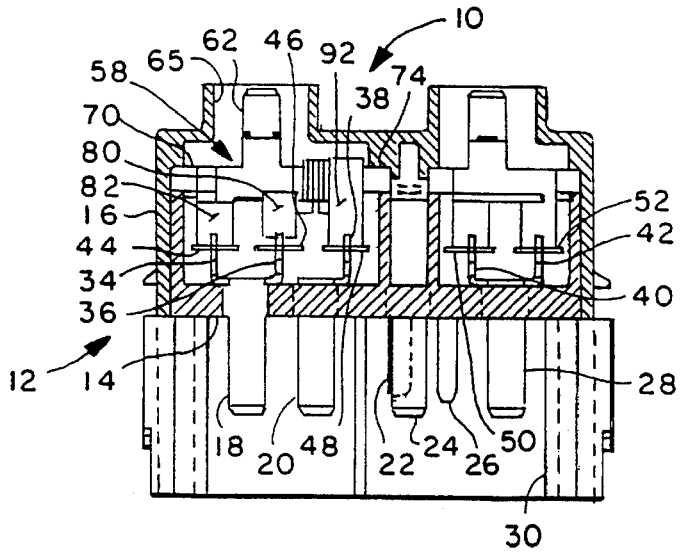
FIG. 1 is a section view in side elevation of the switch assembly of the present invention with the user contactable rocker covers removed.
Figure 2:
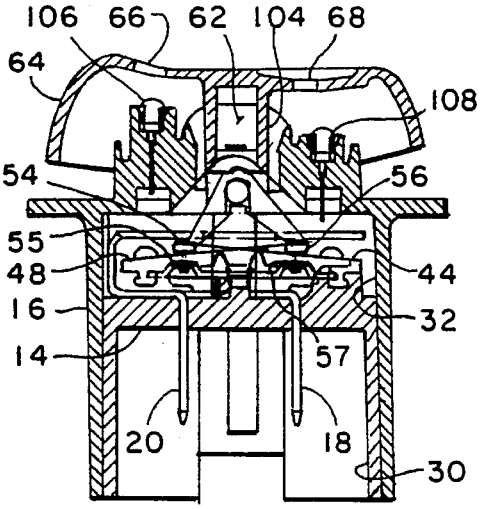
FIG. 2 is a left-hand elevation view of the assembly of FIG. 1 with the end of the case broken away showing the switch in the neutral position.

Referring to FIGS. 1 and 2, the switch assembly is indicated generally at 10 as having a housing means indicated generally at 12 comprising a base 14 and a cover 16 attached to the base. the base includes a plurality of electrical terminals denoted by reference numerals 18–28 which extend into a recess or cavity 30 formed in the base 14 and have portions thereof extending upwardly into a switch cavity 32, formed in the upper portion of the base, and these portions are denoted by reference numerals 34–42 in FIG. 1. The upwardly extending portions of the contact terminals denoted by reference numerals 34–42 each have a switch blade member mounted thereon as denoted respectively by reference numerals 44–52 in FIG. 1. Each of the blades 44–52 has a moveable contact attached to the end thereof and which is disposed adjacent a corresponding stationary contact two of which are shown denoted 55,57 for effecting a switching operation upon movement of the moveable contact. Two of the moveable contacts are illustrated in FIG. 2 and denoted by reference numerals 54,56.

Referring to FIGS. 1, 2, 6 and 7, a rocker means indicated generally at 58 is pivotally mounted in the cover 16 and comprises a first rocker member 60 having a post or paddle 62 extending upwardly therefrom and which extends through an aperture 65 formed in the cover 16. The paddle 62 has received thereon and attached thereover in frictional engagement a rocker cover member 64 which has a pair of spaced light transmitting lenses 66,68 provided therein.

The rocker member 60 has a projection or trunnion 70 provided on one end thereof which is journalled directly in the housing cover and a trunnion or projection 72 extending from the opposite end thereof in coaxial arrangement with trunnion 70. Trunnion 72 has provided on the end thereof a reduced diameter cylindrical journalling surface 74. The member 60 also has extending from the end thereof in spaced parallel relationship with the projection 72 a second lug or projection 76 which has a notch or cutout 78 formed therein.

The rocker member 60 has extending angled downwardly therefrom a first cam portion 80. A second cam portion 82 extends downwardly from the opposite side of member 60 from cam 80 thereof and generally in an opposite direction and is spaced along the axis of rotation at a remote station from the first cam 80.

A rotary bias means in the form of torsion spring 84 is received over the cylindrical portion of the projection 72 and has one reaction end thereof 86 anchored in slot 78.

A second rocker member 88 is provided and has a bore 90 formed therethrough which is sized to be journalled on the surface 74 of projection 72 for rotation with respect thereto. The second rocker member 88 has a third cam portion 92 formed thereon which is positioned to extend downwardly generally in a direction coincident with cam portion 80 of member 60 but angularly offset therefrom about eight degrees (8°). Member 88 also has a lug 94 provided on the side of cam portion 92 which lug has a notch 96 formed therein into which is received and registered thereagainst the remaining reaction end 98 of spring 84 and which exerts a force thereon in a counter-clockwise direction about the surface 74.

The rocker member 88 also has extending from the side thereof a lug 100 which has provided thereon a stop or limit surface 102 which is registered against the side 104 of lug 76 on member 60. The assembly of the first rocker member 60, torsion spring 84 and second rocker member 88 thus forms the rocker means or subassembly 58. It will be understood that the end of the journal surface 74 provided on projection trunnion 72 of member 60 is journalled for rotation in the cover member 16 as shown in FIG. 1. Lug 70 on the opposite end of the member 60 is also journalled in the cover 16 as shown in FIG. 1 such that the user paddle 62 on the rocker member 60 extends upwardly through the aperture 65 provided in the cover. The rocker cover 64 is mounted through aperture 65 by means of a sleeve or tube portion 104 which extends downwardly through the aperture 65 and registers on the paddle 62.

Typically a pair of light emitting source such as light emitting diodes 106, 108 are mounted in the cover 16 on stanchions or towers provided thereon. The light emitting diodes 106, 108 are disposed respectively beneath the light transmitting lenses 66,68 for illumination of the lenses.

Figure 3:
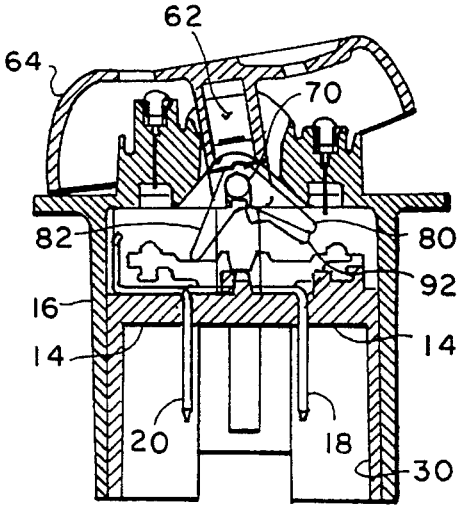
FIG. 3 is a view similar to FIG. 2 with the switch rocker rotated approximately 9° counter-clockwise from the neutral position.

Referring to FIGS. 1 and 3, the rocker cover and rocker member 60 have been rotated 9° in a counter-clockwise direction from the neutral position of FIG. 2 such that the cam 82 has contacted switch blade member 44 and effected movement of the moveable contact 54 thereon for closing against the stationary contact 55 for completing a circuit such as, for example, the circuit for driving a power window motor in the direction to raise the window.

Figure 4:
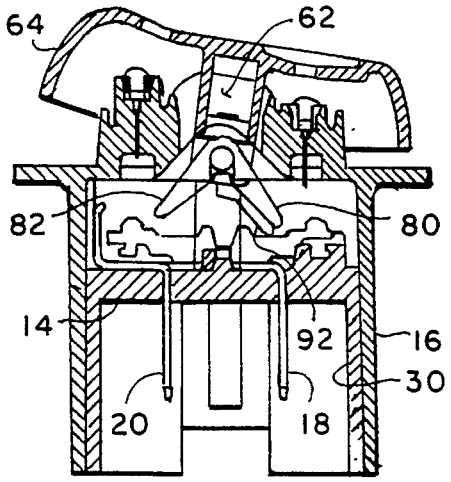
FIG. 4 is a view similar to FIG. 2 showing the switch rocker rotated approximately 9° clockwise from the neutral position of FIG. 2.

Referring to FIGS. 1 and 4, the rocker cover and rocker member 60 have been rotated in a clockwise direction 9° from the neutral position of FIG. 2 in which position the cam member 92 of rocker member 88 has contacted switch blade member 48 for effecting movement of moveable contact 56 in a downward direction to close against stationary contact 57 for completing a circuit such as the circuit for energizing a power window motor for rotation in a direction so as to lower the window.

Figure 5:
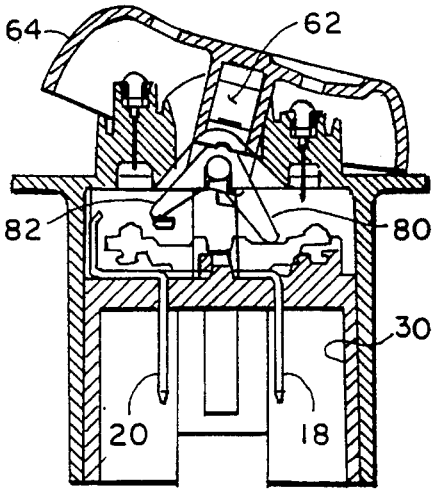
FIG. 5 is a view similar to FIG. 2 showing the switch rocker rotated clockwise 15° from the neutral position.
Figure 7:
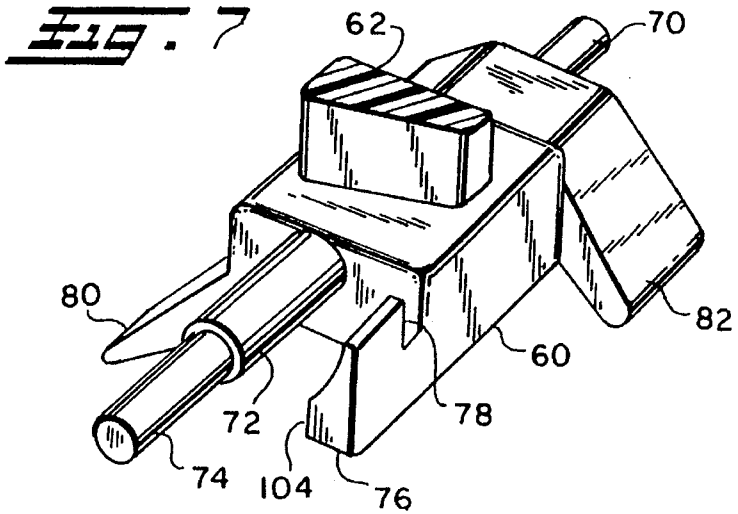
Figure 8:
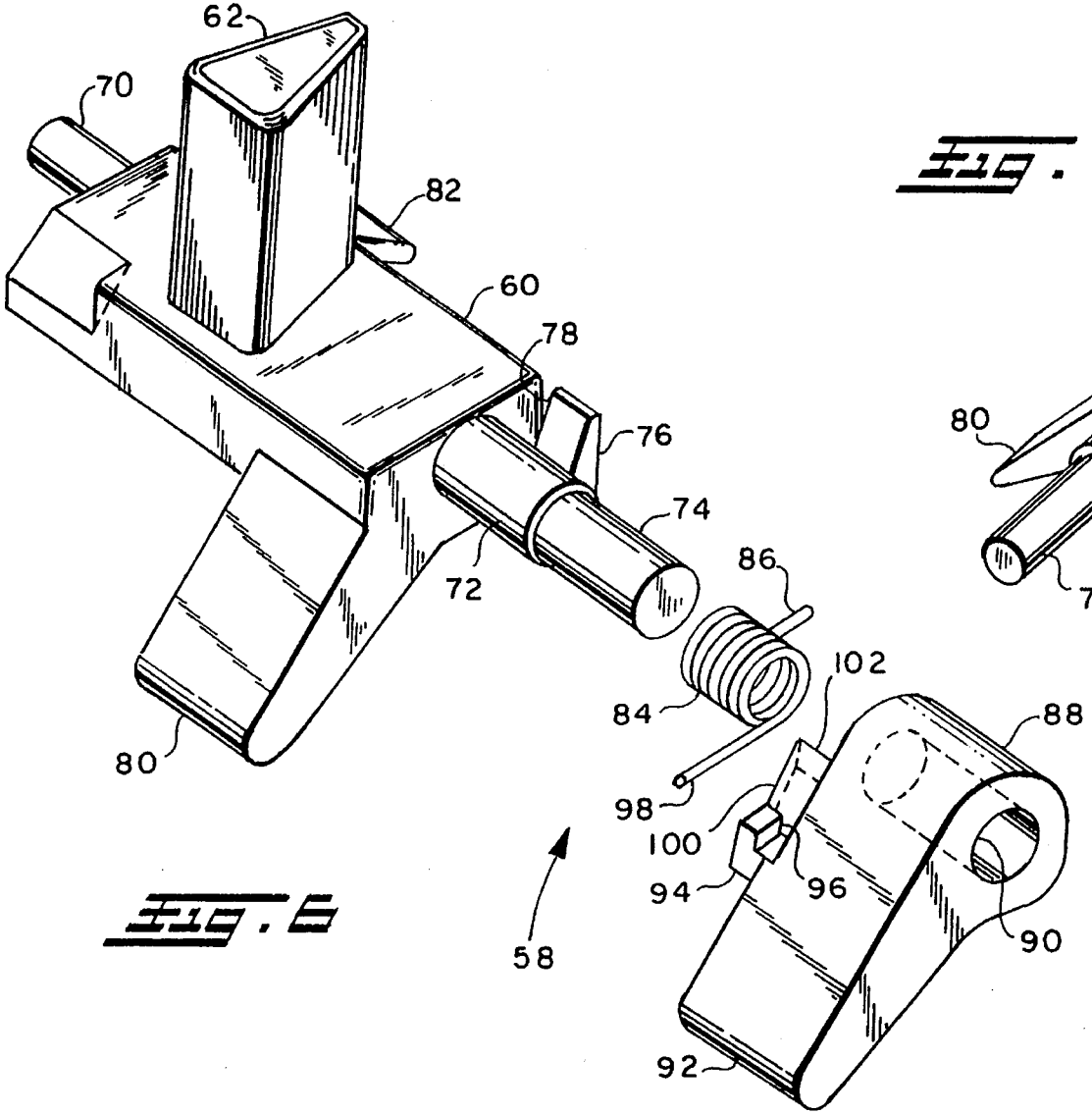

Referring to FIGS. 1 and 5, the rocker cover 64 has been rotated an additional amount in the clockwise direct from the position shown in FIG. 4 to a position of about 15° from the neutral position of FIG. 2. With the rocker member 60 rotated to the position shown in FIG. 5, overtravel of the member 92 against switch blade 48 has been absorbed by resilient deflection of torsion spring 84 and movement of cam 92 with respect to cam 80. When the rocker member 60 is rotated to the position shown in FIG. 5, cam member 80 makes contact with switch blade member 46 and effects actuation of a set of contacts which are directly behind contacts 56,57 and not visible in the drawings but which operate similar to contacts 56,57 for energizing a circuit such as, for example, an "auto-down" control circuit for effecting continuous rotation of the power window motor in the direction to lower the window even though the user may release pressure on the rocker cover member 64 and subsequently permits the switch to return to the neutral position of FIG. 2.

The switch of the present invention thus provides for actuation of a first switch by rotation of a rocker actuator in one direction and upon continued rotation of the rocker actuator in the same direction absorbs overtravel of a first cam portion against the actuated switch by resilient deflection of the first cam about a shaft coincident with rotation of the rocker member until a second cam portion contacts a second switch and effects actuation of the second switch. The rocker actuator means of the present switch assembly absorbs the overtravel by a resilient bias means in the form of a torsion spring to provide a tactilely discernable increase in the force required for the continuous movement of the actuator to provide feedback to the user of the state of actuation of the switches.

Although the invention has hereinabove been described with respect to the illustrated embodiment, it will be understood that the invention is capable of modification and variation and is limited only by the following claims.

I claim:

1. A switch assembly comprising (a) housing means having disposed therein a plurality of switches, each of said switches with a stationary and a moveable contact and an actuator member operable upon movement to effect opening and closing of the moveable contact against the stationary contact for each of the switches;

(b) a user moveable rocker member pivotally mounted on said housing means for rotation in opposite directions about an axis and including a first cam portion thereof operable upon user movement in a first direction to effect movement of said actuator of one of said plurality of switches for effecting closing of the contacts thereof;

(c) a second rocker member mounted for rotation about said axis on said housing means and including a second cam portion operable upon continued user movement of said first rocker member in said first direction to effect movement of said actuator of a second one of said plurality of switches and closing of the contacts thereof; and, (d) means for biasing said second rocker member in a direction opposite said first direction and operable to provide for lost-motion between said first and second rocker members during said continued movement.

2. The switch assembly defined in claim 1, wherein said means for biasing includes a torsion spring.

3. The switch assembly defined in claim 1, wherein said first and second rocker members include portions thereof interconnected in a journalling relationship.

4. The switch assembly defined in claim 1, wherein said first rocker member includes a user contactable portion extending exteriorly of said housing means.

5. A switch assembly comprising:

(a) housing means;

(b) a plurality of electrical switches mounted in said housing means;

(c) rocker means rotatably mounted on said housing means and user moveable in opposite directions and operable for sequentially actuating selected ones of said plurality of switches;

(d) means for providing a limited resiliently biased lost motion during user movement of said rocker means in one direction between actuation of a first of said switches and a second of said switches.

6. The switch assembly defined in claim 5, wherein said rocker means includes a first user moveable rocker member and a second rocker member interconnected with said first rocker member in a journalling arrangement; and, said means for providing lost motion includes torsion spring means having one reaction end anchored to said first rocker member and an opposite reaction end anchored to said second rocker member.

7. The switch assembly defined in claim 5, wherein said means for providing a lost motion includes a torsion spring.

8. The switch assembly defined in claim 5, wherein said housing means includes light source means; and, said rocker means includes light transmitting means operable to provide an illuminated indicia of a position, of said rocker means.

9. A method of actuating a plurality of switches sequentially comprising:

(a) providing a housing and disposing a plurality of switches therein;

(b) pivoting a first rocker member on said housing for rotation about an axis;

(c) pivoting a second rocker member on said housing for rotation about said axis;

(d) interconnecting said first and second rockers for relative rotation therebetween; and (e) rotating said first and second rocker members and actuating a first switch with said second rocker member, continuing rotation of said first rocker member in a limited resiliently biased lost motion with said second rocker member and actuating a second switch by rotation of said first rocker member.

* * * * *